United States Patent [19]

Kiba

[11] 4,400,082

[45] Aug. 23, 1983

[54] CLEANING APPARATUS

[75] Inventor: Akira Kiba, Toyokawa, Japan

[73] Assignee: Minolta Camera Kabushiki Kaisha, Osaka, Japan

[21] Appl. No.: 358,610

[22] Filed: Mar. 15, 1982

[30] Foreign Application Priority Data

Mar. 20, 1981 [JP] Japan ..... 56-40583

[51] Int. Cl.[3] ..... G03G 21/00

[52] U.S. Cl. ..... 355/15; 15/256.53

[58] Field of Search ..... 355/15, 3 R; 15/256.51, 15/256.53; 118/652

[56] References Cited

U.S. PATENT DOCUMENTS

| | | | |
|---|---|---|---|
| 3,724,019 | 4/1973 | Shanly | 15/256.53 |
| 3,740,789 | 6/1973 | Ticknor | 15/256.53 |
| 3,859,691 | 1/1975 | Katayama et al. | 15/256.1 |
| 4,111,545 | 9/1978 | Meltzer | 355/15 |
| 4,127,083 | 11/1978 | Sesoko | 355/15 X |
| 4,168,901 | 9/1979 | Ito et al. | 355/15 X |

OTHER PUBLICATIONS

*Research Disclosure,* "Oscillating Cleaner", Sep. 1977, p. 14.

*Primary Examiner*—R. L. Moses

*Attorney, Agent, or Firm*—Wenderoth, Lind & Ponack

[57] ABSTRACT

A cleaning apparatus for removing toner remaining on a moving photoconductive member has a resilient blade in bearing contact with the surface of the photoconductive member and reciprocatingly movable laterally of the direction of movement of the surface, a seal member provided at each end of the photoconductive member and having a width in the direction of the lateral movement of the blade equal to at least the range of lateral movement of the corresponding end of the blade, the seal member being disposed in contact with the rear surface of the blade in the range of lateral movement of the blade end. Toner particles are thereby prevented from falling from the blade off the end of the photoconductive member.

8 Claims, 9 Drawing Figures

CLEANING APPARATUS

The present invention relates to a cleaning apparatus for electronic copying machines, electronic printers, etc., and more particularly to a cleaning apparatus by which the toner remaining on a photoconductive member is removed by a resilient blade provided in bearing contact with the surface of the photoconductive member and reciprocatingly movable axially of the photoconductive member.

BACKGROUND OF THE INVENTION AND PRIOR ART

Cleaning blades which reciprocate transversely to the surface of a photoconductive surface, such as a drum, are known, and are described, for example, in U.S. Pat. Nos. 3,740,789 and 4,111,545.

It has already been proposed to provide a packing or like member at each of the axially opposite ends of such a photoconductive drum for sealing the side space around the end of the drum as disclosed, for example, in U.S. Pat. No. 3,859,691 (FIG. 11). However, the packing or like seal member, when merely provided at the drum end, will contact the drum over a large area and adversely affect the drum. The large contact area is also likely to deform the seal member owing to deterioration, permitting toner particles to fall through the resulting clearance. Furthermore, the seal member, if completely sealing off the space around each drum end, limits the lateral movement of the cleaning blade, which in turn inevitably leaves an uncleaned portion at one end of the drum when the blade is moved toward the other end. Since the blade is unable to act on the side sealed portions of the drum, there arises the need to use a photoconductive drum of correspondingly increased length. Thus the conventional side seal method has various problems especially when it is used for cleaning apparatus (such as those disclosed in U.S. Pat. Nos. 3,740,789, 4,111,545, etc.) wherein the blade is adapted to reciprocatingly move laterally.

SUMMARY OF THE INVENTION

An object of the present invention is to overcome the above problems encountered with the cleaning apparatus of the type wherein the blade is reciprocatingly moved laterally and to provide a cleaning apparatus which comprises a seal member provided at each end of a photoconductive member and having a width covering at least the range of lateral movement of the corresponding end of a blade, the seal member being disposed in contact with the rear surface of the blade in the range of lateral movement of the blade end to thereby reduce the area of sliding contact of the seal member with the photoconductive member and effectively prevent toner particles from falling off the end of the photoconductive member while permitting the blade to slide laterally.

The end or side seal provided for the blade according to the invention is adapted for sliding contact with the photoconductive member over a decreased area so as to reduce the possible damage to the photoconductive member. Further since the seal is adapted to contact the blade on the rear surface thereof under a pressure which will not influence the cleaning action, the seal permits smooth lateral movement of the blade while assuring reliable sealing.

Another object of the invention is to provide a cleaning apparatus wherein the seal member has a seal portion adapted to contact the surface of the photoconductive member on one side of the blade adjacent its cleaning edge, whereby toner particles are prevented from invading the range of lateral movement of the blade end.

Another object of the invention is to provide a cleaning apparatus which comprises a cleaning unit in which the seal member is fixed to the cleaning unit and can be held retracted from the surface of the photoconductive member and also from the blade while the apparatus is out of operation so as not to cause damage to these components.

Another object of the invention is to provide a cleaning apparatus in which the cleaning unit is withdrawable in a direction parallel to the axis of the photoconductive member and which includes a member for preventing the setting of the cleaning unit in position in which it is in pressing contact with the photoconductive members, unless the unit is fully pushed in, the cleaning unit thus being prevented from improper setting.

Another object of the invention is to provide a cleaning apparatus in which the blade is easily mountable on and detachable from a blade holder due to the provisions of a clearance in the holder.

Still another object of the invention is to provide a cleaning apparatus in which the blade is properly mountable in the blade holder by a comb-shaped spacer.

BRIEF DESCRIPTION OF THE DRAWINGS

FIG. 1 is a sectional view showing a cleaning apparatus according to the invention in its operative position in a photocopying machine, printer of the like;

FIG. 2 is a sectional view showing the apparatus in its inoperative position from which it can be withdrawn from the machine, printer or the like;

DETAILED DESCRIPTION OF THE INVENTION

An embodiment of the invention will now be described with reference to the drawings.

Figure 1:
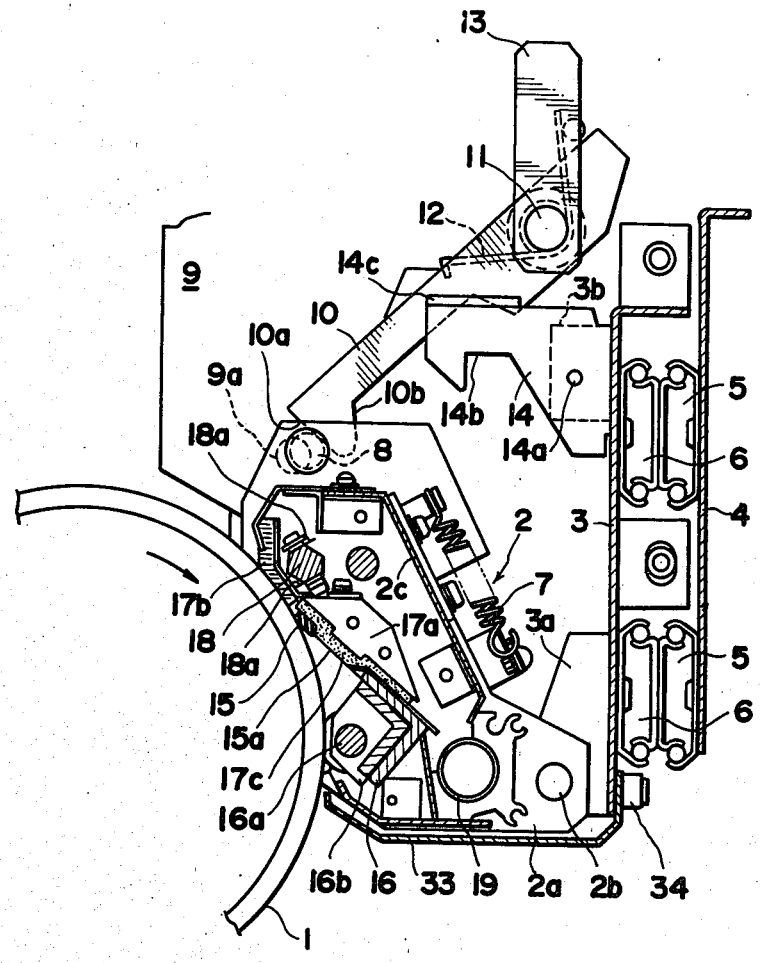
Figure 2:
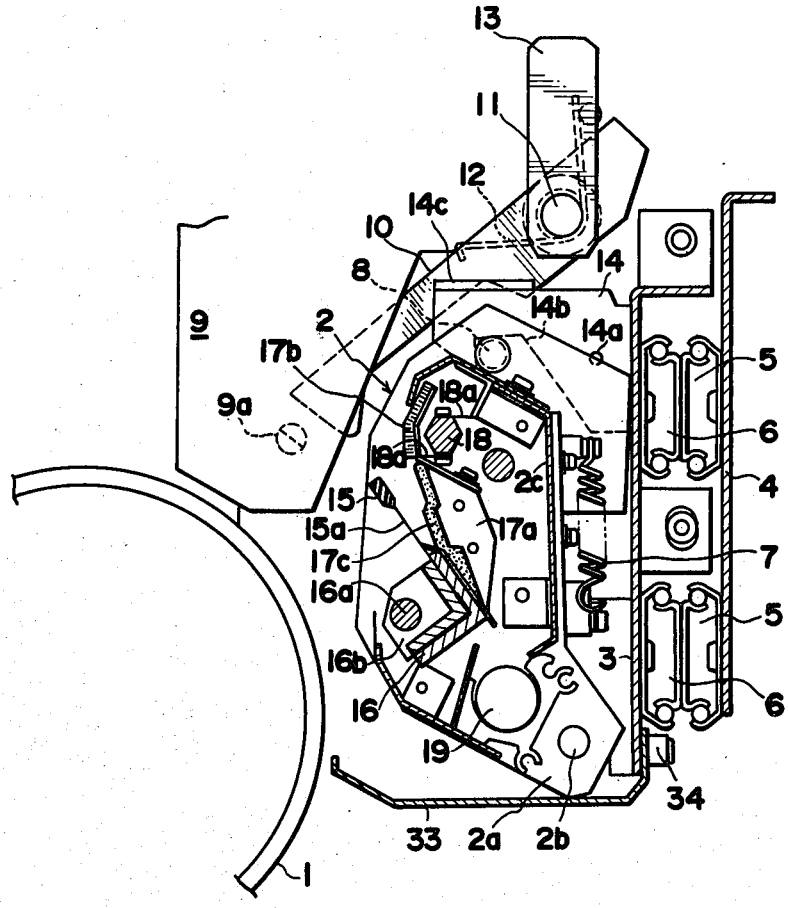

FIGS. 1 and 2 show a cleaning apparatus disposed at a specified location which is close to a photoconductive drum 1, for example, of an electronic printer and on which residual toner is carried. A cleaning unit 2 having blade means, seal means for confining the toner and toner scraping means is shown in FIG. 1 in its operative position. FIG. 2 shows the unit 2 in an inoperative position from which it is withdrawable from the printer.

The photoconductive drum 1 is rotatable in the direction of the arrow shown in FIG. 1. The cleaning unit 2 has side plates 2*a* turnably supported by pivots 2*b* on brackets 3*a* fixed to a support 3. The support 3 is mounted on movable rails 6 movable on rails 5 fixed to a frame 4 of the machine main body, the rails making the support 3, movable axially of the drum 1, so that the unit 2 can be moved out of the main body of the machine. A blade pressing coil spring 7 has one end engaged with a rear plate 2c of the unit.

The unit 2 is so positioned relative to the pivots 2b that it tends to turn counterclockwise in FIG. 2, i.e. toward the drum 1, under the effect of gravity. A retaining rod 8 attached to the unit side plates 2a bears against a cutout portion of a pin 9a fixed to a side plate 9 of the main body, whereby the unit 2 is retained in the operative position shown in FIG. 1.

A lock lever 10 pivotally movably supported by a pin 11 on the main body side plate 9 is biased counterclockwise by a spring 12. At its forward end, the lock lever 10 has an outer slanting edge 10a for locking the rod 8 in bearing contact with the cutout pin 9a and an inner slanting edge 10b for temporarily holding the rod 8 in the course of its movement as described hereinafter.

A release lever 13 for releasing the lock lever 10 is connected by the pin 11 to the lever 10. A latch lever 14 supported by a pin 14a on a bracket 3b attached to the unit support 3 tends to be turned counterclockwise under the effect of gravity and is held in the illustrated position by a stop (not shown). The lever 14 has a recessed portion 14b for engaging the rod 8 of the unit when the unit is moved to the position shown in FIG. 2 and a knob 14c which can be grasped for lifting and turning the lever 14 counterclockwise.

A blade 15 of elastic rubber is disposed adjacent the drum 1 in the first quadrant with respect to phantom vertical and horizontal lines through the center of the drum 1 in FIG. 1, and has a leg portion 15a of phosphor bronze by which the blade is mounted on a blade holder 16. The holder 16 is attached to a support rod 16a by a mounting member 16b. A press lever 16c having the other end of the coil spring 7 engaged therwith is fixed to the opposite ends of the rod 16a, whereby the rod 16a is biased to rotate in a direction so as to press the blade 15 toward the drum at all times. The rod 16a is supported by the unit side plates 2a and is reciprocatingly movable laterally, i.e. parallel to the axis of the drum, by a drive assembly to be described later.

The blade 15 is held in pressing contact with the surface of the photoconductive drum 1 by the force of the coil spring 7, with the blade edge extending in the opposite direction to the direction of rotation of the drum 1, as shown in FIG. 1. The force of pressing contact is set to a suitable magnitude by adjusting the force of the coil spring 7.

Figure 3:
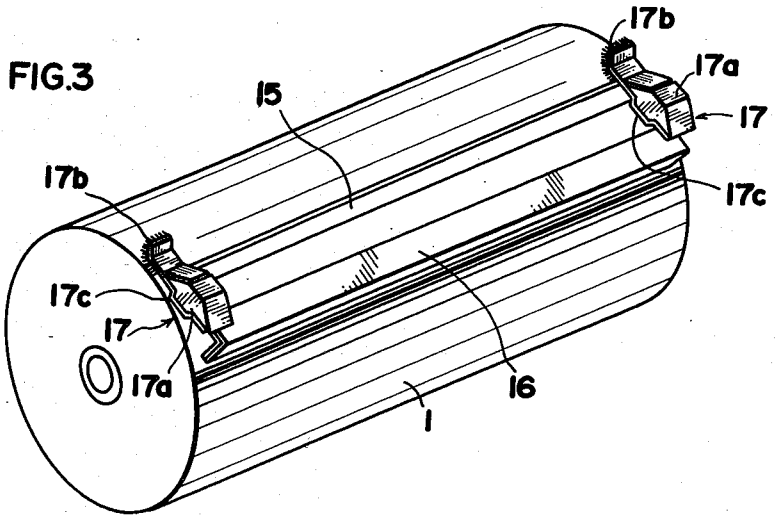
FIG. 3 is a perspective view showing the arrangement of seal members according to the invention.

When the blade 15 moves reciprocatingly parallel to the axis of the drum 15 through a distance hereinafter called the range of lateral movement, unless prevented, toner particles removed from the drum by the blade will fall off the opposite ends of the drum. To prevent this, the present cleaning apparatus includes individual side seals 17 provided only at the opposite ends of the drum 1 and each having a width covering at least the range of lateral movement of the corresponding end of the blade 15 as seen in FIG. 3. Each side seal 17 has a support member 17a fastened to the unit side plate 2a by screws, a seal portion 17b adapted to contact the surface of the drum on one side of the blade adjacent its cleaning edge, and a seal portion 17c adapted to contact the rear surface of the blade 15. The seal portion 17b comprises an elastic member, such as a fabric flocked with acrylic fibers, which will not cause damage to the surface of the drum, while the seal portion 17c comprises an elastic member, for example, a polyurethane form such as Moltopren (name used in trade and manufactured by INOVE MTP Co., Ltd. Japan) which will bear on the rear surface of the blade 15 for sealing against it without influencing the cleaning action of the blade 15 by the pressing contact of the blade with the drum. Accordingly the blade 15 can be moved reciprocatingly between the drum surface and the seal portion 17c.

The elastic members providing the seal portions 17b and 17c are joined to the seal support member 17a by an adhesive or the like so they can be replaced easily.

The toner collected by the blade 5 will accumulate on the blade edge portion during the repetition of printing cycles. To scrape the accumulation of toner off the blade, a scraper 18 is located at a position opposed to the blade edge.

The toner is scraped off blade 15 by a pair of sheets 18a of a material such as Mylar, a polyester film sold by E.I. Dupont de Nemours & Co., Inc., fastened to the stem of the scraper 18 by screws. The scraper 18 is driven from the drum 1 to mitigate the load on the blade 15. The entrance to a toner recycling bore 19 is opened by an unillustrated shutter plate provided on the unit support 3 when the unit 2 is brought to its operative position as shown in FIG. 1. The bore 19 is closed when the unit is moved to the inoperative position as shown in FIG. 2.

Figure 4:
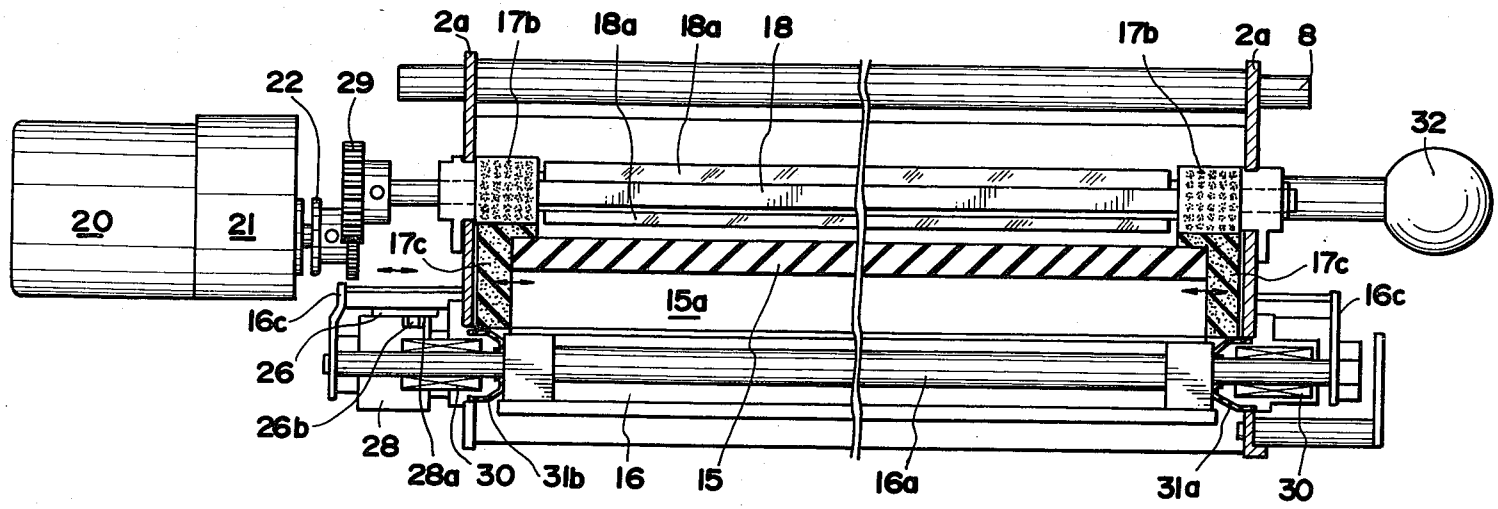
FIG. 4 is a fragmentary front view, partially in section, showing the cleaning apparatus of FIG. 1 from one side thereof closer to the photoconductive drum.
Figure 5:
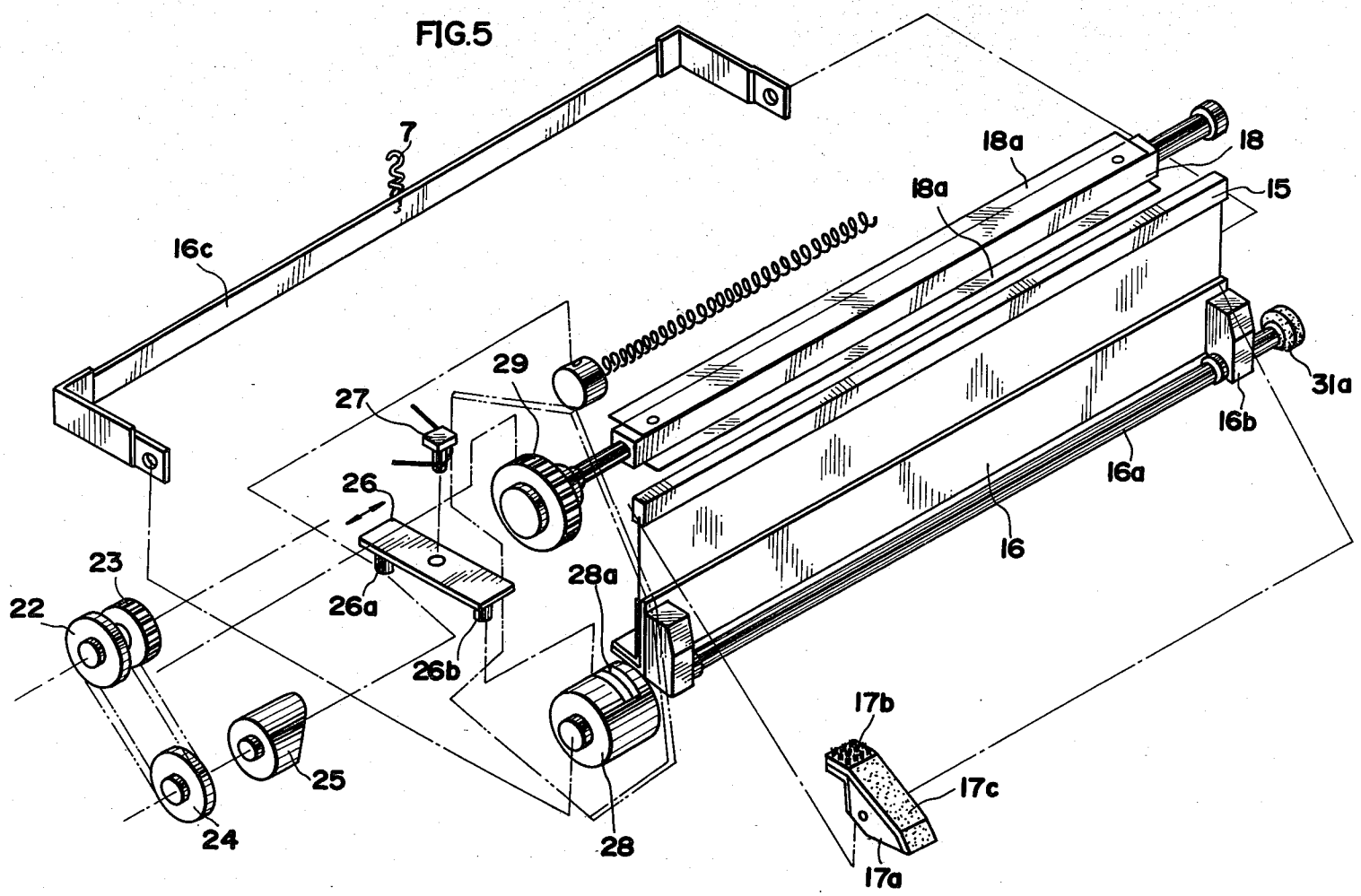
FIG. 5 is an exploded perspective view showing the drive assembly illustrated in FIG. 4.

FIGS. 4 and 5 show the arrangement of the blade 15 and the side seals 17, a mechanism for reciprocating the blade 15 laterally and a mechanism for driving the scraper 18.

The torque of a drive motor 20 is delivered through a gear head 21 to a sprocket wheel 22 and a gear 23. The sprocket wheel 22 transmits the torque to a sprocket wheel 24 by a chain shown in phantom lines, which in turn rotates a cam 25 connected directly thereto. The cam 25 bears against a projection 26a on a lever 26 to reciprocate the lever 26 in the directions of the arrow about a fulcrum 27. The lever 26 has a projection 26b engaging in a groove 28a of a grooved member 28 which is fixed to the blade rod 16a, such that the cam 25 causes the lever 26 to reciprocate the rod 16a to move the blade 15 laterally in reciprocation in the directions of the arrows shown in FIG. 4. At this time, the seal portions 17b and 17c of the side seals 17 prevent toner particles from falling off the opposite ends of the drum 1. The groove 28a is so shaped as to assure smooth movement of the blade rod 16. On the other hand, the gear 23 meshes with a gear 29 mounted directly on the shaft for rotating the toner scraper 18.

To prevent the toner for invading slide bearings 30 fixedly mounted on the unit side plates 2a during the reciprocation of the blade rod 16a, diaphragm-like rubber caps 31a and 31b are provided on the rod 16a. Since the rubber caps 31a and 31b absorb stress when pressed on, the rod 16a will not be excessively loaded.

A knob 32 for moving the unit 2 extends from one of the side plates 2a.

When the unit 2 is in its operative position as shown in FIG. 1 and is to be withdrawn from the machine, the release lever 13 is first turned clockwise. As the lever 13 turns, the lock lever 10 rises. The knob 32 is then moved clockwise to pivot the unit 2 around pivots 2b until the rod 8 engages in the recessed portion 14b of the latch lever 14. The side seals 17 are thus moved clockwise to the FIG. 2 position which the side plates 2a of the unit 2, while spring 7 acting on press lever 16c tends to pivot the blade 15 counterclockwise, so that the side seals 17 are spaced from the blade 15 as shown in FIG. 2. When a handle (not shown) for withdrawing the unit 2 is then pulled toward the user, the unit 2 can be withdrawn from the machine by the sliding movement of the movable rails 6, on the fixed rails 5.

When the unit 2 is moved away from the drum 1 preparatory to withdrawal, the toner remaining on the blade 15 will fall off the cleaning edge and adversely affect the charger and eraser (not shown) disposed below the cleaning apparatus. To eliminate this adverse effect, a toner receptacle 33 is provided below the cleaning apparatus for catching all the toner particles falling off the blade 15. The toner receptable 33 is fastened to the unit support 3 by securing knobs 34 and is therefore detachable from the unit 2.

Next, when the unit 2 is to be mounted in place, the blade 15 can not be pressed into contact with the drum 1 unless the unit 2 is pushed into the machine parallel to the axis of the drum 1 to the end of its stroke. Since the rod 8 is shorter than the distance between the side plates 9 (only the rear plate 9 is shown in FIG. 2), the unit 2, if pushed in to the end of its stroke, can be turned by gravity to the FIG. 1 position to bring the blade into pressing contact with the drum 1, but if the unit 2 is pushed in incompletely, the rod 8 will come into contact with the front side plate 9, preventing the unit 2 from turning under the effect of gravity to the position where the blade 15 is in contact with the drum. Thus improper installation of the unit can be prevented. Further when the latch lever 14 is raised to release the rod 8 from the recessed portion 14*b* to allow the unit 2 to turn under the effect of gravity after the unit 2 has been completely moved in, the rod 8 is invariably held temporarily by the inner slanting edge 10*b* of the lock lever 10, with the result that the impact of the unit 2 as it is turning will not be delivered directly to the drum 1. The knob 32 is then moved counterclockwise to push the lock lever 10 up after the rod 8 comes into contact with the inner slanting edge 10*b*, whereby the unit 2 is completely locked in position. Accordingly the unit 2 is provided with a double means for ensuring safe and complete installation.

Figure 6:
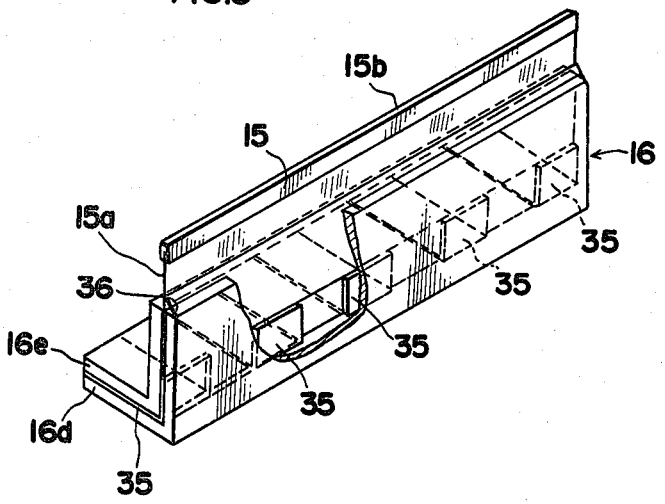
FIG. 6 is a perspective view, partly broken away, showing a blade holder.
Figure 7:
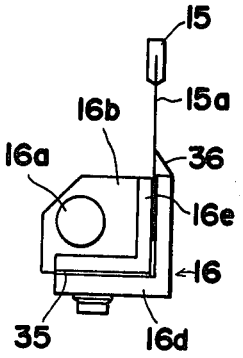
FIG. 7 is a sectional view of FIG. 6.

FIGS. 6 and 7 show the blade holder 16 with the blade 15 held therein. The blade holder 16 comprises a pair of complementary L-shaped members 16*d* and 16*e* one inside the other which are provided for good strength. Spacers 35 are provided between the L-shaped members 16*d* and 16*e* to provide a clearance for making the leg portion 15*a* of the blade 15 easily insertable into or removable from the holder 16. To prevent the toner from entering the clearance when the blade 15 moves laterally, a blade seal 36 is affixed to the L-shaped member 16*d* so that the forward edge of the seal 36 bears on the blade 15 inserted in the holder 16.

If a single piece spacer is used for the holder 16, the toner falling off and accumulating in the clearance above the spacer will undulate the upper surface of the spacer, so that the blade 15 will not be positioned in parallel with the surface of the drum 1. To avoid this, the spacers 35 are in the form of small separate pieces which are spaced from one another for supporting the blade. Five spacers are used for the present embodiment. When the spacers 35 are thus spaced apart, the toner entering the clearance can be caused to fall into the spaces by the lateral movement of the blade 15. As a result, the blade 15 can be supported properly, with the blade edge 15*b* perfectly parallel with the drum surface. Since the blade 15 is merely held between the L-shaped members 16*d* and 16*e*, the blade 15, when deteriorated, can be upwardly pulled out of the holder 6 with ease for replacement when the unit 2 is withdrawn from the machine and, with the blade out of pressing contact with the drum as seen in FIG. 2.

Figure 8A:
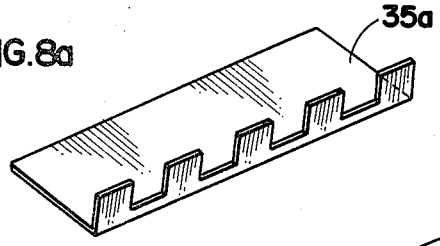
FIGS. 8 (*a*) and (*b*) are perspective views showing modified spacers for the blade holder.
Figure 8B:
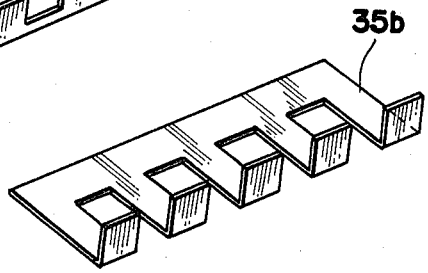

FIGS. 8 (*a*) and (*b*) show modified spacers 35*a* and 35*b*, by which the desired result can also be achieved. The spacers are single piece spacers 35*a* or 35*b* with a plurality of spaced spacer portions along the portion of the clearance which receives the blade 15.

Although the present invention has been fully described by way of example with reference to the accompanying drawings, it is to be noted that various changes and modifications will be apparent to those skilled in the art. Therefore, unless otherwise such changes and modifications depart from the scope of the invention, they should be construed as being included therein.

What I claim is:

1. A cleaning apparatus for removing toner remaining on a moving photoconductive member, said apparatus comprising a resilient blade in bearing contact with the surface of the photoconductive member and reciprocatingly movable laterally of the direction of movement of the surface, a seal member provided at each end of the photoconductive member and having a width in the direction of the lateral movement of said blade equal to at least the range of lateral movement of the corresponding end of the blade, said seal member being disposed in contact with the rear surface of the blade in the range of lateral movement of the blade end, whereby toner particles are prevented from falling from the blade off the end of the photoconductive member.

2. A cleaning apparatus as claimed in claim 1, wherein said seal member has a seal portion for contacting the surface of the photoconductive member forwardly of the blade adjacent its cleaning edge, whereby toner particles are prevented from entering the space through which the blade moves in the lateral movement.

3. A cleaning apparatus as claimed in claim 1 or claim 2, further comprising means on which said seal members are mounted for retracting said seal members from the surface of the photoconductive member.

4. A cleaning apparatus as claimed in claim 3 further comprising means for biasing said resilient blade toward said photoconductive member and, when said seal members are retracted from the surface of said photoconductive member, biasing said resilient blade away from said seal members.

5. A cleaning apparatus for removing toner particles remaining on a moving photoconductive member, comprising:

a support;

brackets fixed to said support;

a cleaning unit having said plates pivotally mounted on said brackets and positioned relative to said pivotal mounting for being turnable toward the photoconductive member;

a support rod supported between said unit side plates and reciprocatingly movable between said side plates laterally of the direction of movement of said photoconductive member, a blade holder attached to said support rod and a resilient blade mounted on said blade holder, and means for biasing said support rod to rotate in a direction for pressing said blade toward the photoconductive member at all times, to urge one edge of said blade against the photoconductive surface as a cleaning edge;

means for moving said support rod reciprocatingly in the direction of its length through a range of lateral movement; and individual side seals only at the opposite sides of the photoconductive member and each having a width in the direction of movement of said support rod at least equal to the range of lateral movement of the corresponding end of said blade, each said seal having a support member fastened to the corresponding end of said blade, each said seal having a support member fastened to the corresponding plate, a seal portion for contacting the surface of the photoconductive member on the side of said blade adjacent its cleaning edge, and a seal portion contacting the surface of said blade which is facing away from the photoconductive surface during movement of the blade through its lateral range of movement.

6. A cleaning apparatus as claimed in claim 5 wherein said support has a rail thereon movable on a rail fixed to a frame of the main body of a machine and extending laterally of the direction of movement of the photoconductive member, whereby said cleaning unit can be moved laterally out of the main body.

7. A cleaning apparatus as claimed in claim 6 wherein said side plates each have a retaining rod thereon, and said apparatus further comprises a pin adapted to be mounted on the main body and having a cutout portion thereon against which said retaining rod is abuttable for retaining said unit in an operative position with said blade pressed against the photoconductive surface.

8. A cleaning apparatus as claimed in claim 5 wherein said blade holder comprises a pair of complementary L-shaped members one inside the other and spacer means between said L-shaped members providing a space therebetween, said blade being held in said space, said spacer means being spaced along the length of said space for providing spaces therebetween for accomodating toner which gets into said space.

* * * * *